US008905773B2

(12) United States Patent
Liang

(10) Patent No.: US 8,905,773 B2
(45) Date of Patent: Dec. 9, 2014

(54) MEMORY SOCKET WITH SPECIAL CONTACT MECHANISM

(71) Applicant: Nanya Technology Corp., Tao-Yuan Hsien (TW)

(72) Inventor: Chih-Cheng Liang, Taoyuan County (TW)

(73) Assignee: Nanya Technology Corp., Kueishan, Tao-Yuan Hsien (TW)

( * ) Notice: Subject to any disclaimer, the term of this patent is extended or adjusted under 35 U.S.C. 154(b) by 68 days.

(21) Appl. No.: 13/772,302

(22) Filed: Feb. 20, 2013

(65) Prior Publication Data

US 2014/0235107 A1 Aug. 21, 2014

(51) Int. Cl.
*H01R 13/15* (2006.01)
*H01R 12/87* (2011.01)

(52) U.S. Cl.
CPC ..... *H01R 12/87* (2013.01)
USPC ..... 439/260

(58) Field of Classification Search
USPC ..... 439/260, 267
See application file for complete search history.

(56) References Cited

U.S. PATENT DOCUMENTS

| | | | | | |
|---|---|---|---|---|---|
| 4,904,197 | A * | 2/1990 | Cabourne | ..... | 439/260 |
| 5,679,018 | A * | 10/1997 | Lopata et al. | ..... | 439/260 |
| 6,004,151 | A * | 12/1999 | Hashiguchi | ..... | 439/260 |
| 6,036,519 | A * | 3/2000 | Lopata et al. | ..... | 439/260 |
| 6,478,596 | B2 * | 11/2002 | Yoshida et al. | ..... | 439/259 |
| 6,478,597 | B1 * | 11/2002 | Roberts et al. | ..... | 439/260 |
| 7,390,208 | B1 * | 6/2008 | Sabo | ..... | 439/267 |
| 7,563,118 | B1 * | 7/2009 | McCauley et al. | ..... | 439/260 |

* cited by examiner

*Primary Examiner* — Gary Paumen
(74) *Attorney, Agent, or Firm* — Winston Hsu; Scott Margo

(57) ABSTRACT

A memory socket with a special contact mechanism comprising a plurality of socket pins arranged in two opposite rows leaning respectively against two inner projecting portions in a socket frame, and an interacting member movably installed between the two rows of the socket pins having a cam portion to pushes the socket pin at both sides away from the interacting member during the insertion of a memory module, so that the socket pin may be bended to contact the inserted memory module.

5 Claims, 4 Drawing Sheets

MEMORY SOCKET WITH SPECIAL CONTACT MECHANISM

BACKGROUND OF THE INVENTION

1. Field of the Invention

The present invention relates generally to a memory socket, and more particularly, to a memory socket with a special contact mechanism for testing a memory module.

2. Description of the Prior Art

As the speed of central processing units (CPUs) keeps increasing, it is incumbent upon the manufacturers of computers and other digital electronic devices to likewise increase the speed of main memory and the speed at which the CPU can communicate with the main memory so as to achieve full speed gain in modern CPUs. The speed at which the CPU can communicate with the main memory is determined by the bus structure that is responsible for passing packets of data between the CPU and the main memory. In order to achieve effective speed gains in CPUs and main memory, the bus structure must be capable of rapidly transmitting/receiving packets of data. Furthermore, it is common for a main memory, which may include a number of memory chips, to be mounted on a printed circuit board (PCB), which may be known as a memory module, such as single in-line memory module (SIMM) or dual in-line memory module (DIMM). The memory module may include a set of pins that provide electrical contacts when the memory module is inserted into a socket slot, for example, on a motherboard.

After manufacturing a memory module, the memory module may be tested by inserting the module into a test socket connected to a testing device. Generally, a conventional and regular memory socket for testing electrical characteristics of the memory module is used. FIG. 1 is a cross-sectional view illustrating a conventional memory socket with fixed socket pins. The memory socket 100 may include a socket frame 101 and resilient socket pins 103. The socket frame 101 may have a slot 105 configured to receive a memory module 107. The resilient socket pins 103 may be arranged at both side surfaces of the slot 105. When the memory module 107 is inserted into the slot, the memory module 107 may exert pressure to the resilient socket pins 103, and accordingly, the memory module 107 may contact the resilient socket pins 103 using friction (a "frictional contact" is accordingly achieved). Contact tabs 109 of the memory module 107 may accordingly electrically contact the resilient socket pins 103. As the memory module 107 is inserted into the slot, the resilient socket pins 103 may push upon the contact tabs 109 of the memory module 107 and the resilient socket pins 103 may thereby be dragged along the contact tabs 109.

In order to insert the memory module 107, it may be required to apply an insertion force greater than a resilient force of the socket pins 103 to the memory module 107. However, the insertion force and/or the dragging of the resilient socket pins along the contact tabs 109 may cause scratches, breakage, or shortage, etc., on the contact tabs 109 of the memory module 107, and even worse, impact the performance of the memory module under the test.

To avoid the scratch damages as much as possible, a conventional method adopted in the industry is: 1) limiting the cycling times of the test socket; 2) advocating correct and standardized gestures for inserting and removing the memory module, and 3) optimizing the size and shape of the socket pins.

With regard to all of the aforementioned solution to the test damages, however, the contact mechanism between the memory module and the memory socket is still a frictional contact mechanism. That is, the scratches resulting from the contact friction between the contact tab and socket pin can't be completely prevented. Accordingly, it is necessary for the industry to develop a novel memory socket with a brain-new contact mechanism for the memory socket, in order to avoid the scratches during the test of the memory module.

SUMMARY OF THE INVENTION

To overcome the above-mentioned drawbacks in prior art, a novel memory socket is provided in the present invention. The memory socket of the present invention features a unique design of resilient contact pins activated by a delicate interacting mechanism. This kind of unique design is particularly suitable for testing the freshly-made memory module, especially for DIMM-type memory module, to avoid scratches on the contact tabs on the memory module during the test.

The object of the present invention is to provide a memory socket with a special contact mechanism comprising a plurality of socket pins arranged in two opposite rows leaning respectively against two inner projecting portions in a socket frame, and an interacting member movably installed between the two rows of the socket pins having a cam portion for pushing the socket pin away from the interacting member during the insertion of a memory module, so that the socket pin may be bended to contact the inserted memory module.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The accompanying drawings are included to provide a further understanding of the embodiments, and are incorporated in and constitute apart of this specification. The drawings illustrate some of the embodiments and, together with the description, serve to explain their principles.

In the drawings.

Figure 1:
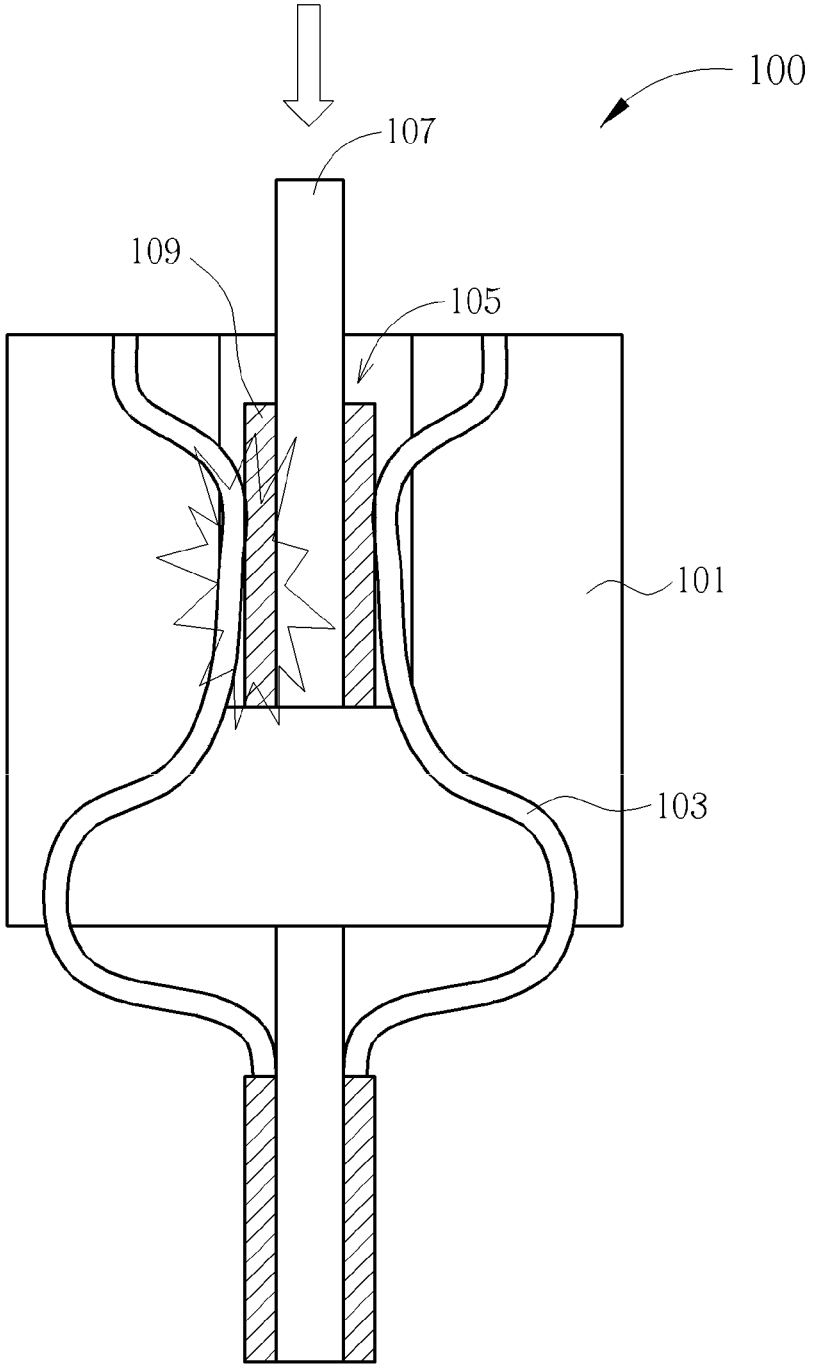
FIG. 1 PRIOR ART
FIG. 1 is a cross-sectional view illustrating a conventional memory socket with fixed socket pins in prior art.

It should be noted that all the figures are diagrammatic. Relative dimensions and proportions of parts of the drawings have been shown exaggerated or reduced in size, for the sake of clarity and convenience in the drawings. The same reference signs are generally used to refer to corresponding or similar features in modified and different embodiments.

DETAILED DESCRIPTION

In the following detailed description of the exemplary embodiment, reference is made to the accompanying drawings, which form a part thereof, and in which are illustrated by way of illustration of specific embodiments in which the invention may be practiced. These embodiments are described in sufficient details to allow those skilled in the art to practice the invention. It is to be understood that other embodiments may be utilized and structural, logical, or electrical changes may be made without departing from the scope of the present invention. The following detailed description is, therefore, not to be taken in a limiting sense, and the scope of the present inventions is defined only by the appended claims. Furthermore, certain terms are used throughout the following descriptions and claims to refer to specific components. As one skilled in the art will appreciate, the manufacturers may refer to a component by different names, for example, socket pins or golden fingers. This document does not intend to distinguish the components that differ in name but not function.

It should be understood that although the exemplary embodiments of the present invention are illustrated and described herein as specifically suitable to a test socket, the socket described herein may be used as a memory module socket for receiving memory modules on a motherboard of a computer, or on another form of circuit board. Moreover, the structure illustrated and described herein is not limited to a test socket for a memory module, the described structure may be used as a test socket or an actual socket for a central processing unit (CPU), a removable memory card such as an SD card, a PCI expansion card, or a test socket or an actual socket for any other form of removable electronic module.

Figure 2:
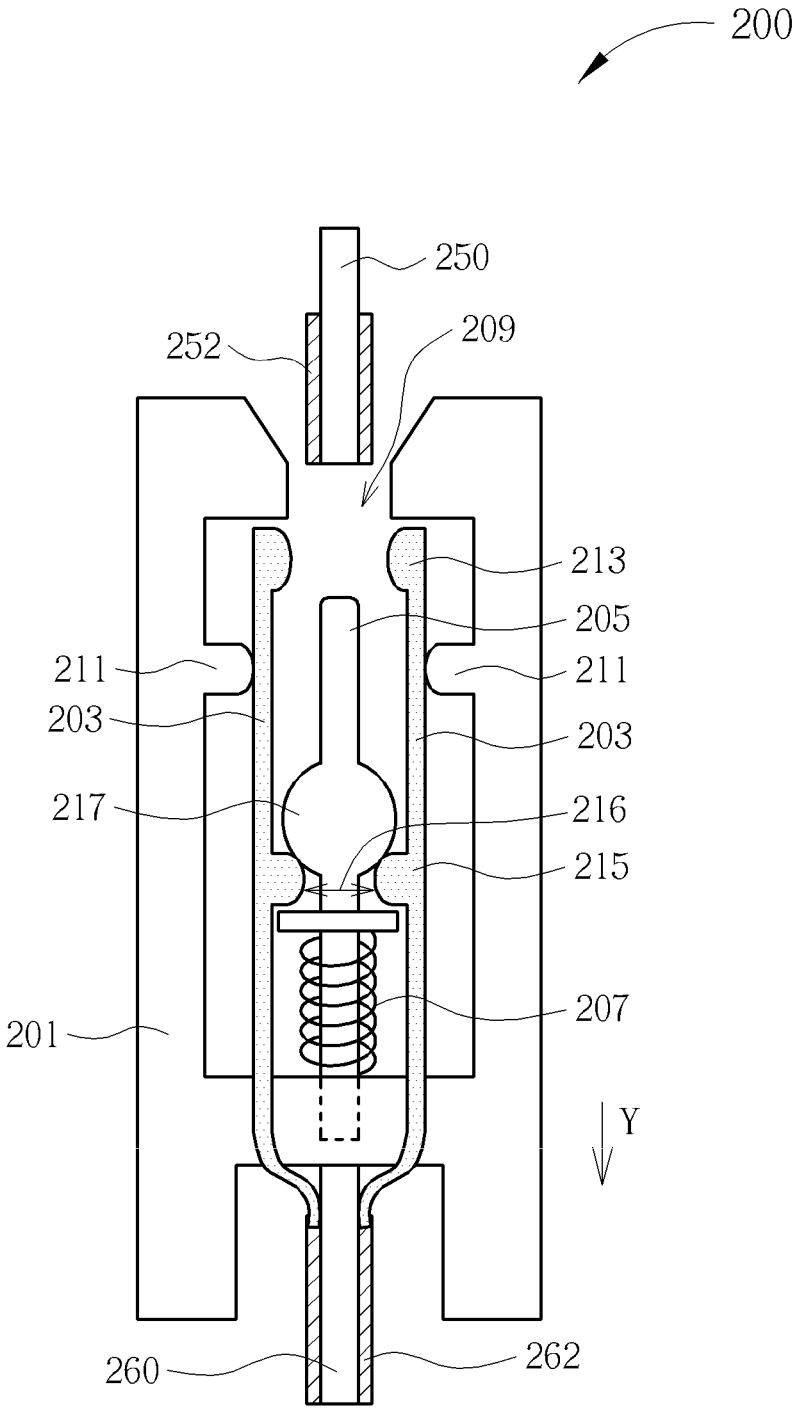
FIG. 2 is a cross-sectional view illustrating a memory socket with a special contact mechanism before the insertion of a memory module in accordance with the exemplary embodiment of the present invention.

Please now refer to FIG. 2, which is a cross-sectional view illustrating a memory socket 200 with a special contact mechanism before the insertion of a memory module 250 according to an exemplary embodiment of present invention. The memory socket 200 of the present invention may include a socket frame 201, a plurality of socket pins 203, an interacting member 205 and a spring 207.

Figure 4:
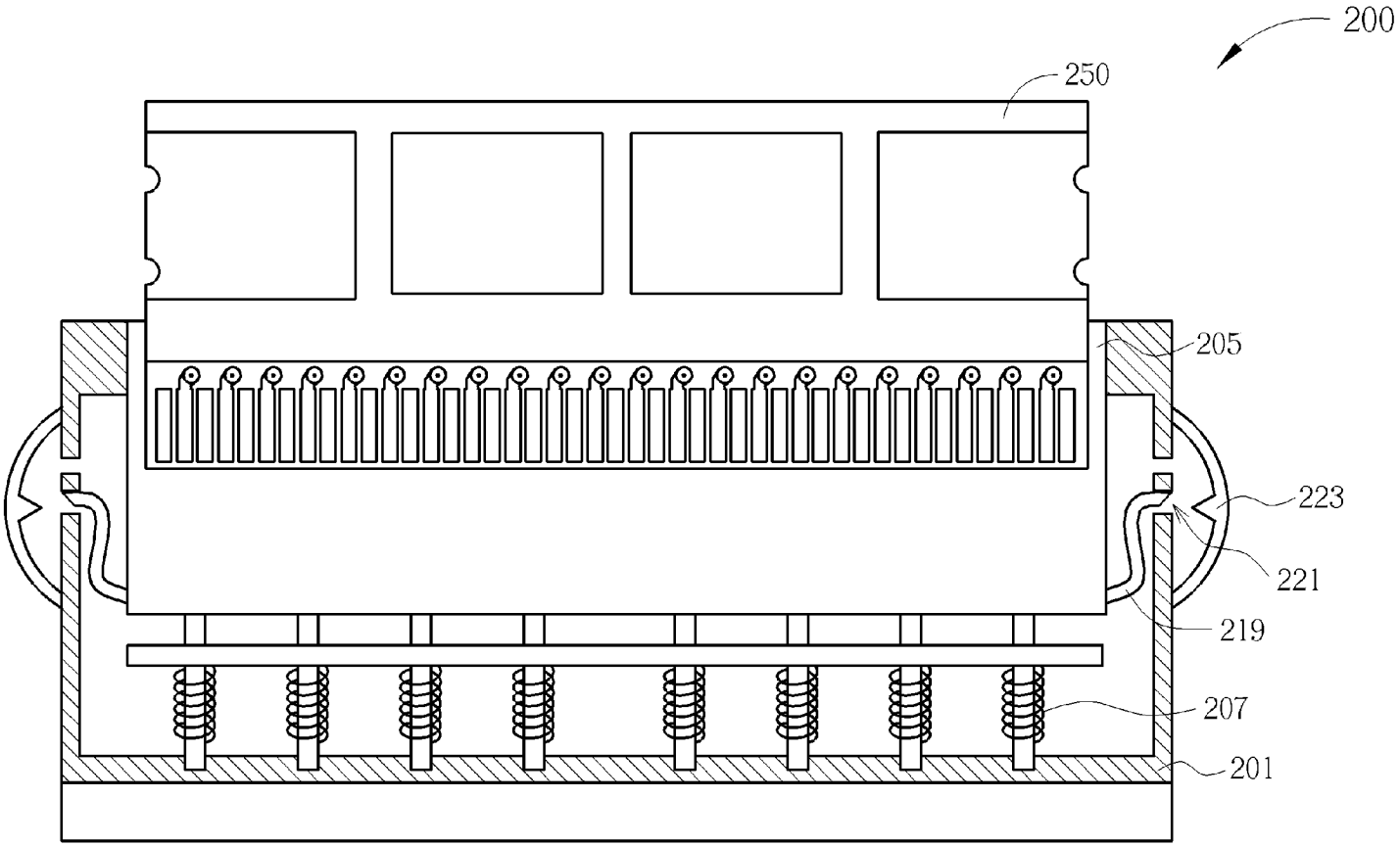
FIG. 4 is a side view illustrating a memory socket of the present invention with a memory module mounted in the socket frame.

The socket frame 201 have a slot 209 configured to receive an object, such as the memory module 250. The memory module may include a single in-lined memory module (SIMM), a dual in-lined memory module (DIMM), etc. The SIMM may include a printed circuit board (PCB) and semiconductor packages mounted on a single surface of the PCB. The DIMM may include a PCB and semiconductor packages mounted on both surfaces of the PCB. In one exemplary embodiment, as shown in FIG. 4, the memory module 250 may have a thin plate shape, and the socket frame 201 may have a long rectangular parallelepiped shape. The slot 209 may be formed at a whole upper surface of the socket frame 201. During the installation, the memory module 250 is inserted into the socket frame 201 in a substantially vertical direction. Accordingly, a vertical guide (not shown) may be provided on the inner sidewall of the socket frame 201 to facilitate the insertion of the memory module 250.

Please refer again to FIG. 2, the socket frame 201 is provided with two inner projecting portions 211. In the exemplary embodiment, the inner projecting portions 211 may be two opposite transverse bars protruding inwardly from both inner sidewalls of the socket frame 201. The inner projecting portion 211 of the socket frame 201 is configured to resist against the socket pins 203 when the socket pins 203 are subject to the bending force. Detailed descriptions will be explained in following embodiment.

In the exemplary embodiment, a plurality of socket pins 203 are provided in the memory socket 200. The socket pins 203 are arranged in two opposite rows leaning respectively against the two inner projecting portions 211 in the socket frame 201. One end of the socket pin 203 may be fixed on the socket frame 201 and the other end of the socket pin 203 serves as a contact end 213 to electrically contact the contact tab 252 of the memory module 250. Each socket pins 203 fixed on the socket frame 201 is further electrically connected to a contact tab 262 of a testing module 260, and accordingly, the test current may be supplied to the contact tab 252 of the memory module 250 through the socket pin 203 connecting with the testing module 260. Therefore, the number of the socket pins 203 may be substantially the same as that of the contact tabs 252 of the memory module 250. According to exemplary embodiments of the present invention, the socket pin 203 may be brought into contact with the contact tab 252 of the memory module 250 at substantially the same time or after the memory module 250 is fully engaged into the slot 209. In this way, the socket pin 203 may be prevented from dragging against the contact tab 252 of the memory module 250 as it is inserted into the memory/test socket 200.

In the exemplary embodiment, each socket pin 203 is provided with an inwardly-projecting portion 215. The inwardly-projecting portions 215 at both sides are opposite to each other and are spaced-apart from each other by a space 216. The inwardly-projecting portions 215 are configured to be pushed simultaneously by a cam portion 217 of the interacting member 205 during the memory module 250 is inserted into the socket frame 200.

Please refer again to FIG. 2, the interacting member 205 is provided in the memory socket 200. In the exemplary embodiment, the interacting member 205 may be a thin plate movably installed between the two opposite rows of the socket pins 203 in the inserting direction (i.e. vertical direction) of the memory module 250. More specifically, as shown in FIG. 2 and FIG. 4, the interacting member 205 is resiliently supported by a plurality of springs 207 in an upward direction (also referred as an ejecting direction) on the bottom surface of the memory socket 201, thus the memory module 250 may be readily ascended due to the returning force of the spring 207 when the interacting member 205 is released. In order to prevent the test current from flowing through the interacting member 205, the interacting member 205 may include an insulating material. Optionally, a groove 218 may be formed on the bottom of the socket frame 201 to provide the space for receiving a part of the interacting member 205 during the insertion.

In the exemplary embodiment, as shown in FIG. 2, the interacting member 205 is provided with the cam portion 217 protruding from both lateral surfaces of the interacting member 205. The cam portion 217 of the interacting member 205 is configured to push the inwardly-projecting portions 215 of the socket pins 203 at both sides away from the interacting member 205 while the memory module 250 is inserted into the socket frame 201. Detailed descriptions of the component interaction will be explained in the following embodiment.

With regard to the detailed configuration of the exemplary embodiment of the present invention, the inner projecting portion 211 of the socket frame 201 is protruding inwardly from the inner sidewall of the socket frame 201 in a level between the contact end 213 of the socket pin 203 and the inwardly-projecting portion 215 of the socket pin 203, and the cam portion 217 is protruding from both sides of the interacting member 205 in a level between the inner projecting portion 211 of the socket frame 201 and the inwardly-projecting portion 215 of the socket pin 203. By using this configuration, the socket pins 203 could be bended by the relative movements of the inwardly-projecting portions 215 of the socket pins 203 and the inner projecting portions 211 of the socket frame 201.

Figure 3:
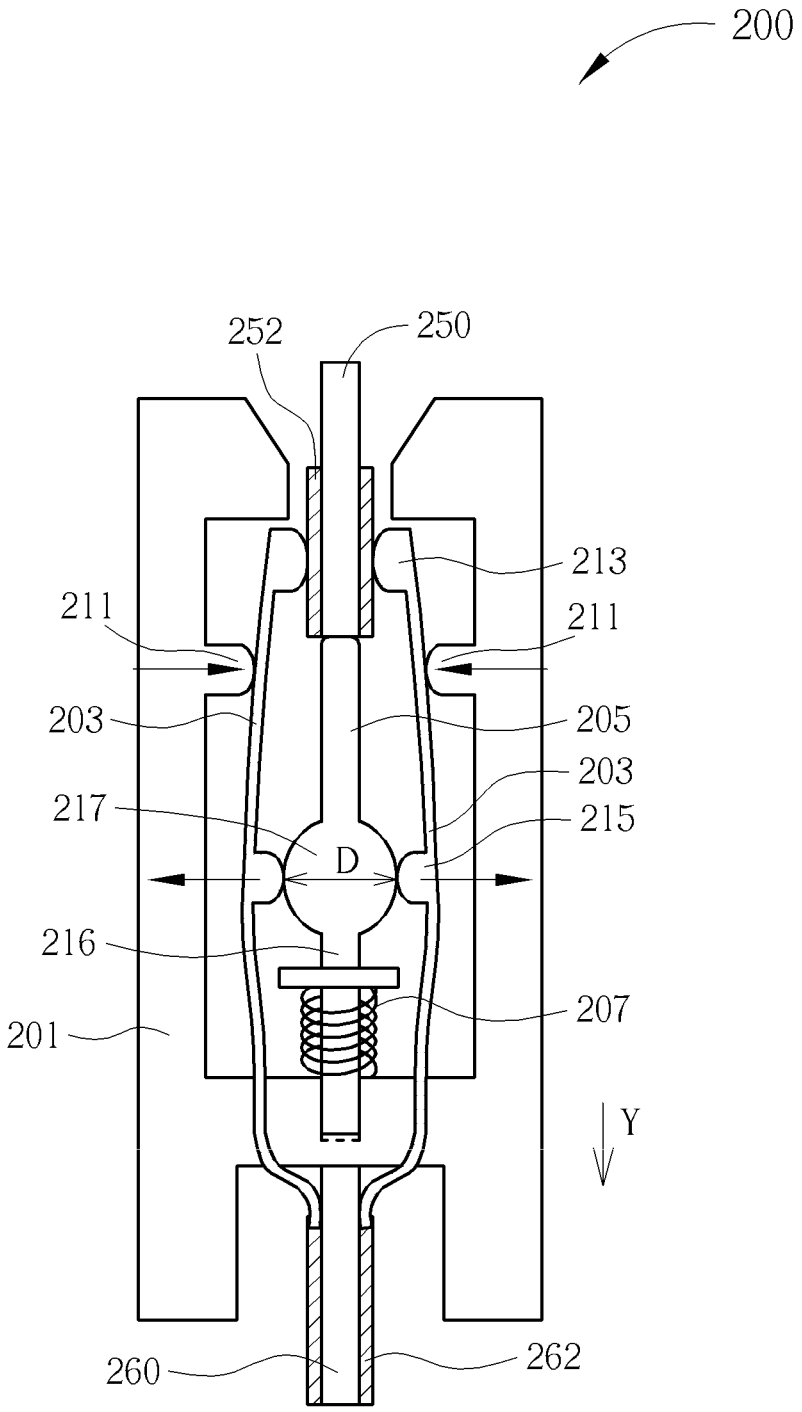
FIG. 3 is a cross-sectional view illustrating a memory socket with a special contact mechanism after the insertion of a memory module in accordance with the exemplary embodiment of the present invention.

Please now refer to FIG. 3, which is a cross-sectional view illustrating the memory socket 200 with a special contact mechanism after the insertion of the memory module 250 according to an exemplary embodiment of present invention.

As shown in FIG. 3, when the memory module 250 is inserted into the socket frame 201, the interacting member 205 resiliently supported on the socket frame 201 is pressed by the inserted memory module 250, thus the cam portion 217 of the interacting member 205 is forced to move into the space 216 between the two opposite inwardly-projecting portions 215.

Please note that the diameter D of the cam portion 217 is configured to be slightly larger than the space 216 (shown in FIG. 3) between the opposite inwardly-projecting portions 215 before the bending of the socket pins 203. In this configuration, the inwardly-projecting portions 215 of the socket pins 203 at both sides of the interacting member 205 will be pushed aside by the cam portion 217 of the interacting member 205 while the memory module 250 is inserted into the socket frame 201. Therefore, the socket pins 203 are bended by the relative movements (as shown by the arrows in FIG. 3) of the inwardly-projecting portions 215 of the socket pins 203 and the inner projecting portions 211 of the socket frame 201, thereby inwardly moving the contact end 213 of each socket pin 203 to contact a corresponding contact tab 252 of the inserted memory module 250.

In the exemplary embodiment, the feature of grounding surfaces of the cam portion 217 and the inwardly-projecting portions 215 enables the cam portion 217 to be readily pressed into the space between the two opposite inwardly-projecting portions 215 during the insertion of the memory module 250. Also, the grounding surface feature of the inner projecting portions 211 of the socket frame 201 achieves the necessary bending magnitude of the socket pin 203 for the contact end 213 of the socket pin 203 to connect with the contact tab 252 of the memory module 250 when the memory module 250 is fully inserted into the socket frame 201.

Please now refer to FIG. 4, which is a side view illustrating the memory socket 200 of the present invention with the memory module 250 mounted in the socket frame 201. In the exemplary embodiment, as shown in FIG. 4, the interacting member 205 may be further provided with two flexible tenons 219 formed respectively on two lateral sides of the interacting member 205. Correspondingly, the socket frame 201 is provided with two mortises 221 formed respectively on two lateral sides of the socket frame 201. The flexible tenon 219 is configured to be engages into the mortise 221 when the memory module 250 is fully-inserted into the socket frame 201, thereby suppressing the returning force of the spring 207 exerted on the interacting member 205 as well as holding the inserted memory module 250 at the mounting position, i.e. the position which may provides sufficient bending force for the socket pin 203 to contact with the inserted memory module 250.

Additionally, as shown in FIG. 4, the socket frame 201 may be further provided with two flexible releasing portions 223 disposed respectively on the two opposite sidewalls of the socket frame 201. The releasing portions 223 may be pressed into the mortise 221 from the outside of the socket frame 201 by an external force, such as a finger pressing, to release the tenon 219 from the mortise 221. In alternative embodiment, the releasing mechanism other than the releasing portion 223, for example, the latch or the fastener may also be adequately applied in present invention.

The unique design of the delicate interacting mechanism between the memory module 250, the interacting member 205, the socket pins 203 and the socket frame 201 achieves the desired point contact mechanism for the present invention. The so-called point contact mechanism of the present invention may prevent the conventional scratch issue on the contact tabs of the memory module, which is resulted from the friction contact between the socket pins of the memory socket and the contact tabs of the memory module during the insertion.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A memory socket with a special contact mechanism, comprising:

a socket frame having two inner projecting portions;

a plurality of socket pins arranged in two opposite rows leaning respectively against said two inner projecting portions in said socket frame, one end of said socket pin is fixed on said socket frame and the other end of said socket pin is a contact end, each socket pin is provided with a inwardly-projecting portion;

an interacting member movably installed between said two opposite rows of said socket pins in an inserting direction of a memory module, said interacting member is provided with a cam portion;

two flexible tenons formed respectively on two lateral sides of said interacting member and two corresponding mortises formed respectively on two lateral sides of said socket frame, wherein said flexible tenon engages into said mortise when said memory module is inserted into said socket frame; and two flexible releasing portions disposed on said socket frame to release said flexible tenon from said mortise;

wherein said cam portion of said interacting member is configured to push said inwardly-projecting portions of said socket pins away from said interacting member while said memory module is inserted into said socket frame, so that said socket pins are bended by the relative movements of said inwardly-projecting portions of said socket pins and said inner projecting portions of said socket frame, thereby inwardly moving said contact end of each said socket pin to contact said inserted memory module.

2. The memory socket with a special contact mechanism according to claim 1, wherein said contact end of each said socket pin is moved inwardly to contact a corresponding contact tab of said memory module.

3. The memory socket with a special contact mechanism according to claim 1, wherein said inner projecting portion protrudes inwardly from an inner sidewall of said socket frame in a level between said contact end of said socket pin and said inwardly-projecting portion of said socket pin.

4. The memory socket with a special contact mechanism according to claim 1, wherein said cam portion protrudes from said interacting member in a level between said inner projecting portion of said socket frame and said inwardly-projecting portion of said socket pin.

5. The memory socket with a special contact mechanism according to claim 1, further comprising a spring resiliently supporting said interacting member on said socket frame.

* * * * *